US010279998B2

(12) United States Patent
Rowland et al.

(10) Patent No.: US 10,279,998 B2
(45) Date of Patent: May 7, 2019

(54) MANUAL CART LATCH

(71) Applicant: Kann Manufacturing Corporation, Guttenberg, IA (US)

(72) Inventors: Jared Rowland, Dyersville, IA (US); Kenneth Goedken, Dubuque, IA (US)

(73) Assignee: Kann Manufacturing Corporation, Guttenberg, IA (US)

( * ) Notice: Subject to any disclaimer, the term of this patent is extended or adjusted under 35 U.S.C. 154(b) by 359 days.

(21) Appl. No.: 14/994,870

(22) Filed: Jan. 13, 2016

(65) Prior Publication Data

US 2016/0200510 A1 Jul. 14, 2016

Related U.S. Application Data

(60) Provisional application No. 62/103,155, filed on Jan. 14, 2015.

(51) Int. Cl.
*B65F 3/04* (2006.01)
*B65F 3/02* (2006.01)

(52) U.S. Cl.
CPC ..... *B65F 3/04* (2013.01); *B65F 2003/0246* (2013.01)

(58) Field of Classification Search
CPC .... B65F 1/00; B65F 3/005; B65F 3/02; B65F 1/04; B65F 1/12; B65F 1/122; B65F 1/125; B65F 1/1452; B65F 2003/0279; B65F 3/04; B65F 3/041; B65F 3/048; Y10S 220/908
USPC ..... 292/256, 1
See application file for complete search history.

(56) References Cited

U.S. PATENT DOCUMENTS 2,945,718 A * 7/1960 Smith ..... B65D 45/22 220/326
4,182,530 A * 1/1980 Hodge ..... B65F 1/1615 220/210
5,213,382 A * 5/1993 Dawdy ..... B65F 1/1615 292/228
5,224,743 A * 7/1993 Dawdy ..... B65F 1/1615 267/177
5,599,050 A * 2/1997 Tinsley ..... B65F 1/1615 220/908
6,033,178 A * 3/2000 Cummins ..... B60R 9/06 224/402
7,614,637 B1 * 11/2009 Kidd ..... B60D 1/00 224/519
9,085,207 B1 * 7/2015 Sweet ..... B60D 1/24
9,828,224 B1 * 11/2017 Hamilton ..... B66F 9/12
2004/0184902 A1 * 9/2004 Bayne ..... B65F 3/046 414/408
2005/0161906 A1 * 7/2005 Thelen ..... B60D 1/00 280/504
2007/0221695 A1 * 9/2007 Winkler ..... B60R 9/065 224/519
2009/0218829 A1 * 9/2009 Stephens ..... B65F 1/1615 292/233

(Continued)

*Primary Examiner* — Mark A Williams
(74) *Attorney, Agent, or Firm* — Shuttleworth & Ingersoll, PLC; Brett Papendick

(57) ABSTRACT

An attachment for a side loading refuse vehicles wherein the attachment can secure several different types of refuse containers. The attachment is operated without electronics and hydraulics, thus making retrofitting already in-use refuse vehicles easy and inexpensive.

7 Claims, 4 Drawing Sheets

(56) References Cited

U.S. PATENT DOCUMENTS

| | | | | |
|---|---|---|---|---|
| 2010/0090428 | A1* | 4/2010 | Meers | B65F 1/16 280/47.26 |
| 2011/0038696 | A1* | 2/2011 | Ummel, Jr. | B65F 3/04 414/408 |
| 2011/0038697 | A1* | 2/2011 | Arrez | B65F 1/122 414/408 |
| 2014/0306465 | A1* | 10/2014 | Kreitzer | E05F 1/002 292/305 |
| 2016/0159570 | A1* | 6/2016 | Reeb | B65F 1/1615 220/324 |
| 2017/0349374 | A1* | 12/2017 | Haddick | B65F 3/02 |

* cited by examiner

MANUAL CART LATCH

CROSS-REFERENCE TO RELATED APPLICATIONS

The present application claims priority to provisional patent application 62/103,155 which was filed on Jan. 14, 2015, and is hereby expressly incorporated by reference in its entirety.

BACKGROUND

Due to the variety of existing carts and containers utilized to hold refuse, different mechanisms are required to lift and empty such carts and containers into a refuse collection device.

It is an object of the invention to provide an attachment that can lift and empty several types of refuse carts and containers.

It is also an object of the invention to have an attachment that does not rely on hydraulics.

SUMMARY OF THE INVENTION

The present invention provides a solution to engage a variety of carts and containers utilized to store refuse. The invention is an attachment selectively mountable to a side loader refuse collection vehicle. A secondary adapter can be removed from the attachment to facilitate the engagement of a particular cart or container.

DETAILED DESCRIPTION

Figure 1:
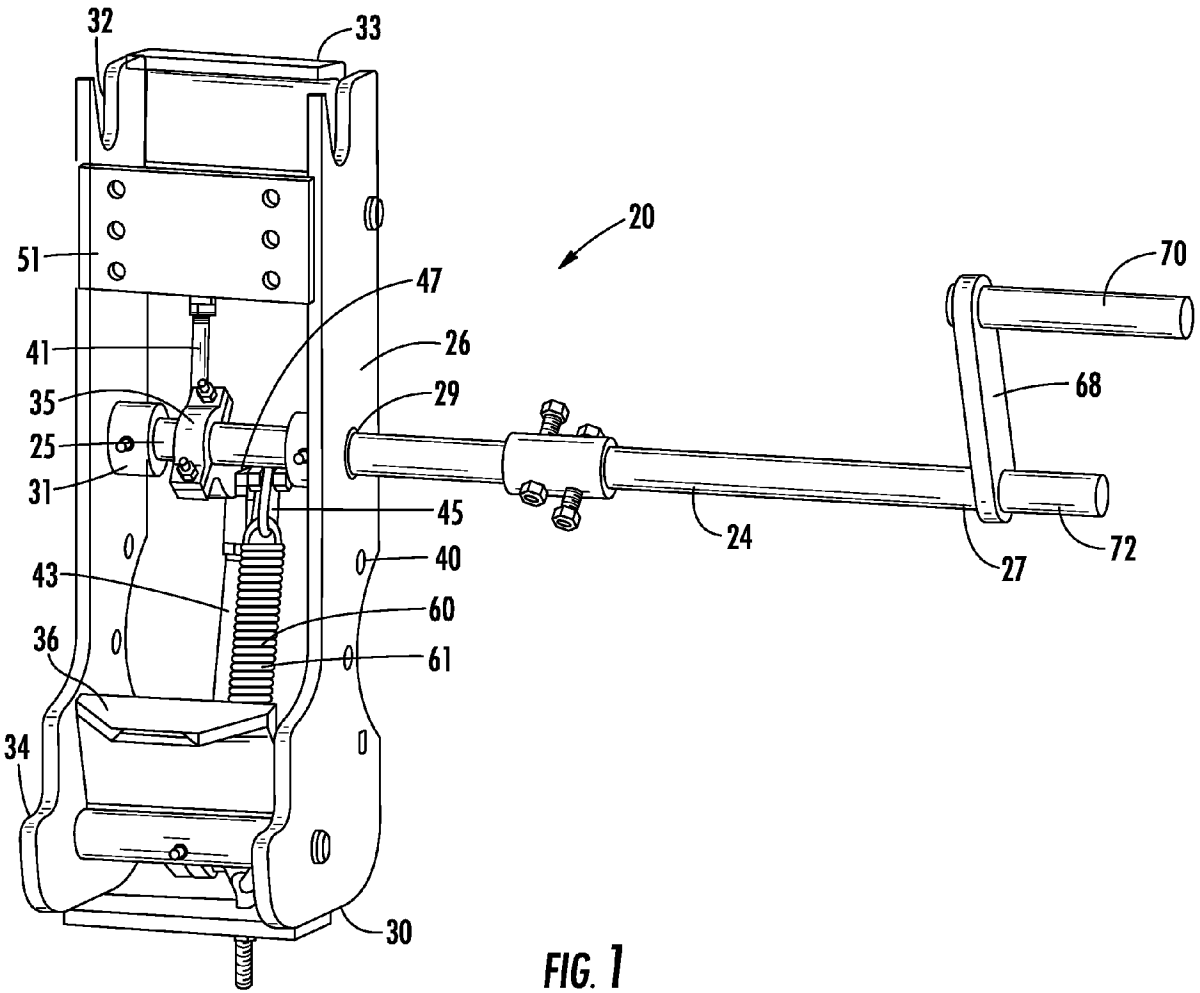
FIG. 1 is a perspective view of the attachment without a secondary adapter.
Figure 2:
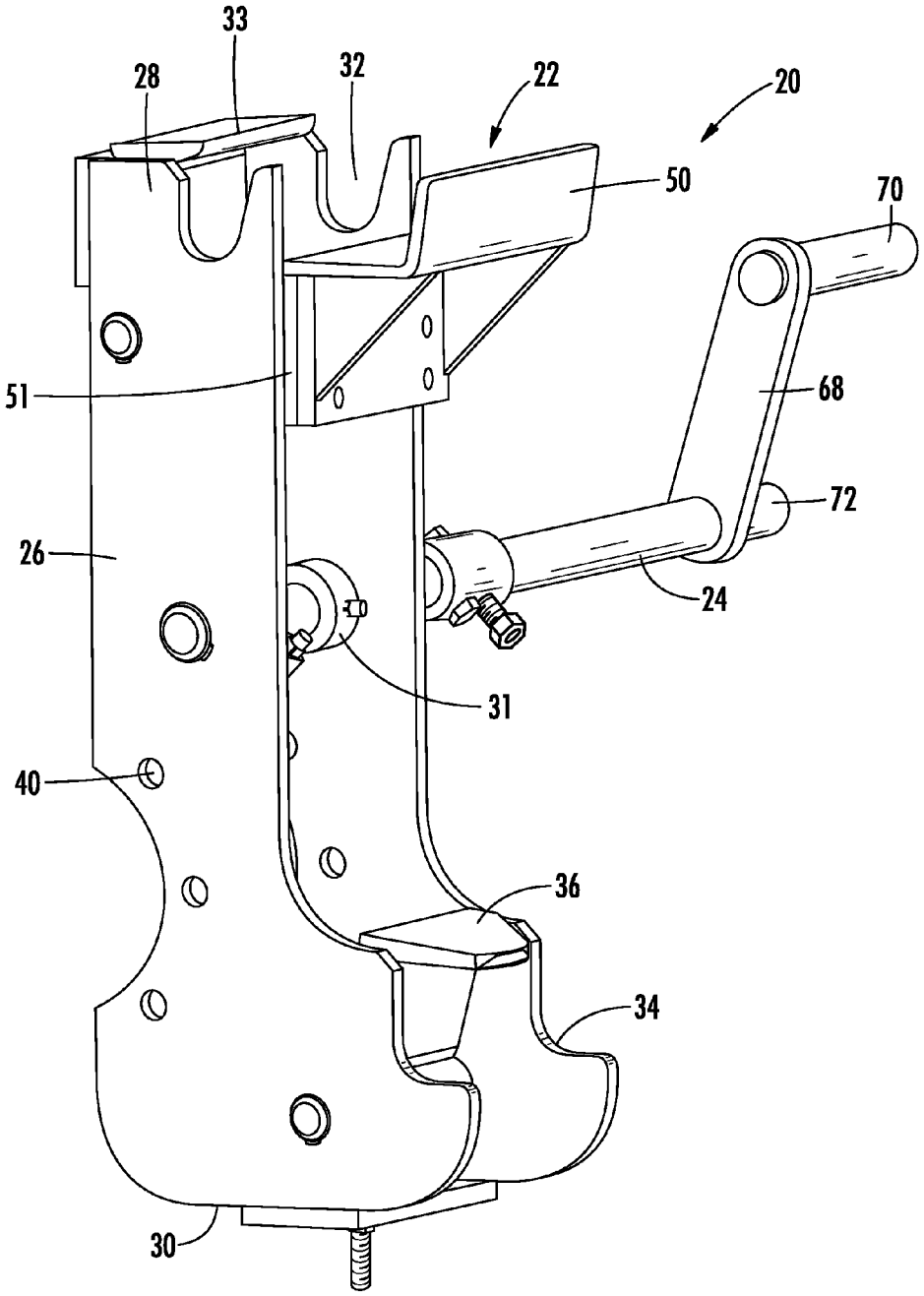
FIG. 2 is a perspective view of the attachment with the secondary adapter.

Now referring to the figures, FIG. 1 shows an attachment 20 without a secondary adapter. FIG. 2 shows an attachment 20 with the secondary adapter 22. As shown in FIGS. 1 and 2, the attachment 20 has a main body 26 with a top 28 and a bottom 30. A first type of refuse container can be engaged by the attachment 20 via upper grooves 32 and lower grooves 34. Preferably the upper grooves are U-shaped. Typically bars of the first type of refuse container are captured in the grooves 32 and 34. A second type of refuse container 82 can be engaged by the attachment 20 with the use of the secondary adapter 22. When the adapter 22 is mounted on the attachment 20 the U-shaped grooves 32 are not utilized.

The attachment 20 comprises a rod 24 having a first end 25 and a second end 27. The first end 25 of the rod 24 is inserted through the main body 26 through an opening 29 in the main body 26. A pair of housings 31 located on inner walls of the main body assist with attaching the rod 24 to the main body 26. The second end 27 is attached to a cross member 68 which is further attached to a first engagement member 70 and a second engagement member 72. The engagement members 70 and 72 engage a particular section of an existing side loading mechanism 80 of a refuse collection vehicle.

A clamp 35 encloses the rod 24 and connects the rod 24 to a first linkage 41 and a second linkage 43. The first linkage 41 is connected to a first locking member 33. The second linkage 43 is connected to a second locking member 36. The second linkage 43 is in communication with a biasing member 60 which can be a spring 61. Preferably the spring 61 can be attached to a flange 45 that is then connected to a first end 47 of the second linkage 43.

Figure 3:
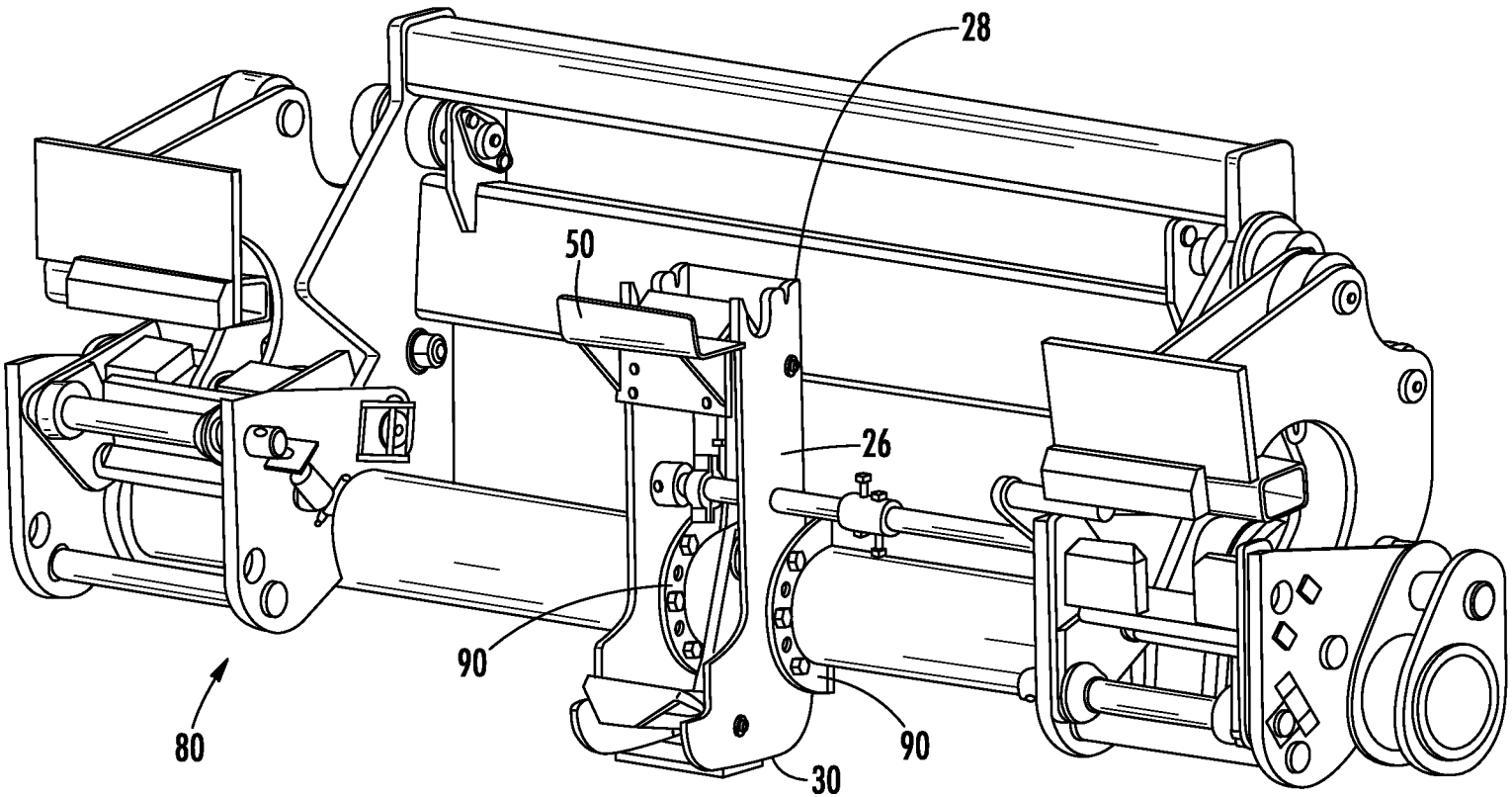
FIG. 3 is a perspective view of the attachment on a side loader.

As seen in FIG. 3, the attachment 20 is connected to the side loading mechanism 80 by means of a pair of connecting members 90 which can be bolted to attachment 20 utilizing openings 40. The attachment 20 can be used without the secondary adapter 22. The secondary adapter 22 comprises an L-shaped bar 50 supported by a pair of flanges 52. In order to utilize the secondary adapter 22, the adapter 22 is fastened to a mounting plate 51 of the attachment 20. The user can selectively choose whether to remove or connect the adapter 22 to the attachment 20 depending on the container or cart to be picked up by the attachment 20.

When the side loading mechanism is activated, a component of the first type of refuse container is engaged by the attachment 20. A first portion of the refuse container is within the upper grooves 32 while a second portion of the refuse container is within the lower grooves 34. Through the use of a manual action by the user, the members 70 and 72 are manipulated such that the rod 24 is rotated in a first direction relative to the attachment 20. The rotation of the rod 24 also rotates the clamp 35. As the clamp 35 is connected to the first linkage 41, the second linkage 43, and the spring 61, these particular parts are affected as well by the rotation. The rotation moves the first linkage 41 such that it moves the first locking member 33 over the first portion of the refuse container and secures the first portion. Similarly, the rotation moves the second linkage 43 such that it moves the second locking member 36 over the second portion of the refuse container. The spring 61 moves along with the second linkage 43. The tension in the spring 61 then provides a force that can maintain the locking members 33 and 36 in place. The spring 61 biases the locking members 33 and 36 in the locked position so the container 82 will not disengage from the attachment 20 when the container 82 is inverted.

The refuse container can then be emptied through the existing side loading mechanism. In order to disengage the container from the apparatus 20, the opposite procedure is utilized. The rod is rotated the opposite direction with a force to overcome the force of the spring. The locking members then no longer secure the first or second portion of the refuse container. Accordingly, the refuse container can be placed back at its original location.

Figure 4:
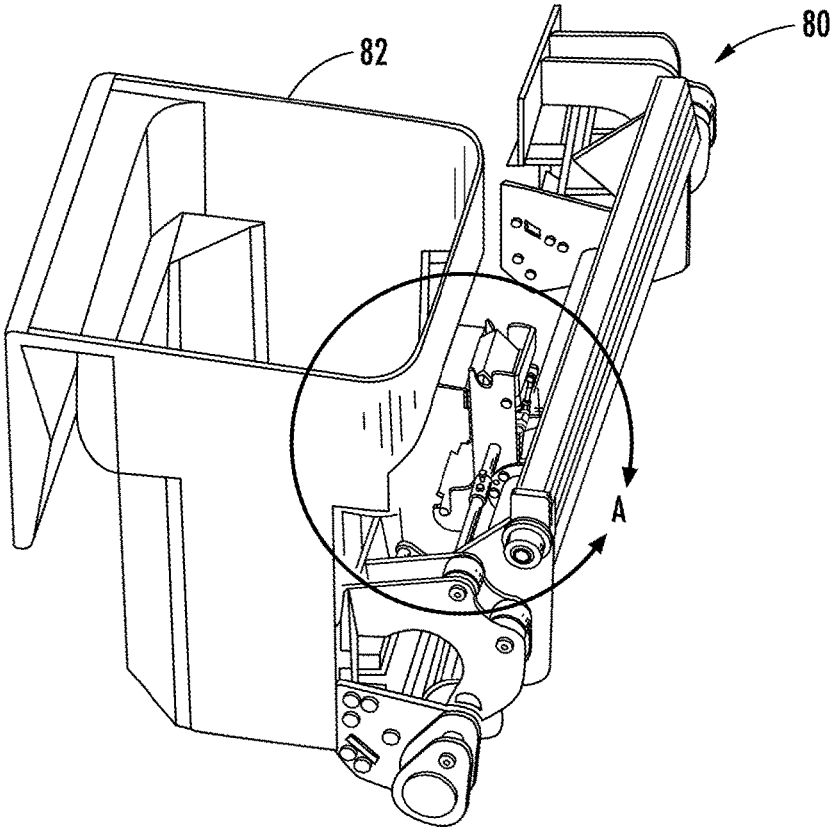
FIG. 4 is a perspective view of the attachment on a side loader and engaging a container.
Figure 5:
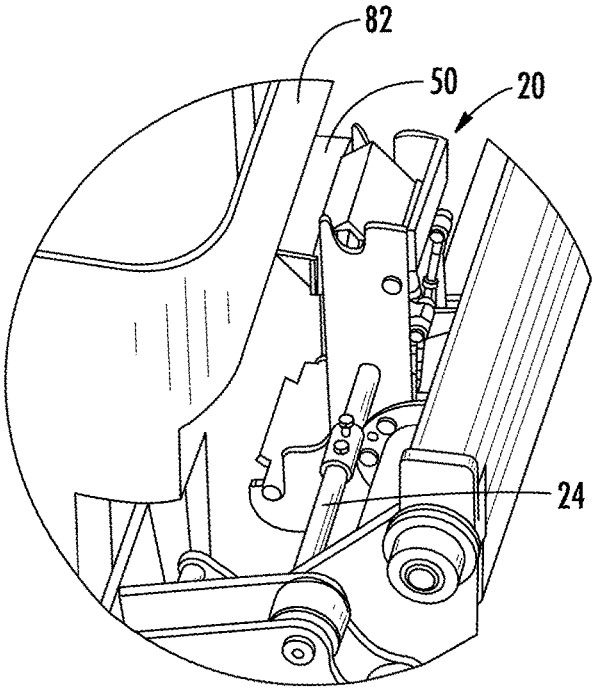
FIG. 5 is a perspective view of the circled area of FIG. 4.

When the secondary adapter 22 is in use, the attachment 20 works in the same way, however, the second portion of the second type of refuse container will not be within the upper grooves 32. Instead, the second portion will be located in the L-shaped bar 50 as shown in FIG. 4. Accordingly, although the first locking member 33 will rotate it will not secure the second portion. The first portion of the second type of refuse container will be secured by the second locking member 36.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents.

What is claimed is:

1. An attachment for a side loading refuse collection vehicle, the side loading refuse collection vehicle capable of picking up a first type of refuse container via a side loading mechanism, said attachment comprising:

a main body;

the main body attachable to the side loading mechanism;

wherein the attachment is configured to pick up a second type of refuse container;

at least one upper groove;

at least one lower groove;

wherein a first portion of the second type of refuse container can be located in the upper groove;

wherein a second portion of the second type of refuse container can be located in the lower groove;

a first locking member;

a second locking member;

the first locking member configured to selectively secure the first portion of the second type of refuse container;

the second locking member configured to selectively secure the second portion of the second type of refuse container;

a rod;

a biasing member;

the rod connected to the biasing member;

wherein the rod can be rotated to effect the biasing member to selectively maintain a force to secure the first type of refuse container within the grooves.

2. The attachment for the side loading refuse collection vehicle of claim 1, wherein:

the first locking member is connected to the rod through a first linkage member.

3. The attachment for the side loading refuse collection vehicle of claim 2, wherein:

the second locking member is connected to the rod through a second linkage member.

4. The attachment for the side loading refuse collection vehicle of claim 3, wherein:

the rotation of the rod in a first direction causes the first locking member to secure the first portion of the second type of refuse container;

the rotation of the rod in a first direction causes the second locking member to secure the second portion of the second type of refuse container.

5. The attachment for the side loading refuse collection vehicle of claim 4, further comprising:

a secondary adapter;

the secondary adapter configured to selectively engage a first portion of a third type of refuse container.

6. The attachment for the side loading refuse collection vehicle of claim 5, wherein:

the biasing member is a spring.

7. The attachment for the side loading refuse collection vehicle of claim 6, wherein:

the main body having a first end and a second end;

the at least one upper groove located at the first end;

the at least one lower groove located at the second end.

* * * * *